United States Patent [19]

Van Naarden

[11] Patent Number: 4,858,312

[45] Date of Patent: Aug. 22, 1989

[54] TORQUE CONTROL FOR AUTOMATIC CONNECTOR ASSEMBLY TOOL

[75] Inventor: Robert Van Naarden, Hinckley, Ill.

[73] Assignee: Ideal Industries, Inc., Sycamore, Ill.

[21] Appl. No.: 182,391

[22] Filed: Apr. 18, 1988

[51] Int. Cl.[4] ..... H01R 43/04

[52] U.S. Cl. ..... 29/861; 29/407; 81/431; 81/467; 81/469; 173/1; 173/12

[58] Field of Search ..... 81/54, 431, 467, 469; 173/12, 19; 29/407, 861

[56] References Cited

U.S. PATENT DOCUMENTS

| | | | |
|---|---|---|---|
| 3,892,146 | 7/1975 | Yasoshima | 81/469 |
| 4,267,914 | 5/1981 | Saar | 173/12 |
| 4,365,527 | 12/1982 | Kruse | 81/431 |
| 4,375,121 | 3/1983 | Sigmund | 173/12 |
| 4,685,050 | 8/1987 | Polzer et al. | 173/12 |
| 4,730,254 | 3/1988 | Voden, Jr. | 173/12 |

*Primary Examiner*—P. W. Echols
*Assistant Examiner*—K. Jordan
*Attorney, Agent, or Firm*—Kinzer,Plyer,Dorn,McEachran & Jambor

[57] ABSTRACT

This invention relates to a method of controlling torque in an electric motor driven connector applicator which applies a desired torque to a twist-on wire connector and a plurality of wire ends positioned within the connector. A desired level of torque is first determined by the connector applicator operator. The torque applied by the connector applicator as it turns a wire connector about the wire ends positioned therein is monitored until the desired level of torque has been reached. The connector applicator is stopped and then rotated in a reverse direction to release the connector held therein.

1 Claim, 2 Drawing Sheets

TORQUE CONTROL FOR AUTOMATIC CONNECTOR ASSEMBLY TOOL

SUMMARY OF THE INVENTION

The present invention relates to a method and apparatus for controlling the torque applied to a twist-on electrical connector and particularly to a method of controlling the torque which assures a uniform and repeatable application of torque in accordance with a pre-application torque setting.

A primary object of the invention is a method of the type described which includes a comparison circuit for continually monitoring the torque applied by an applicator tool drive motor and discontinuing the application of torque when the applied torque reaches a predetermined reference.

Another purpose is a simply constructed reliably operable control system for maintaining uniform torque applications to twist-on electrical connectors.

Another purpose is a method of applying torque to a twist-on electrical connector which relieves the operator of any function other than starting the application sequence.

Another purpose is a method of controlling a torque applicator tool for twist-on electrical connectors which is totally automatic.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Ideal Industries, Inc., of Sycamore, Ill., the assignee of the present application, has for some years supplied an automatic connector assembly machine which was effective to apply torque to a twist-on electrical connector with wire ends positioned therein. See U.S. Pat. No. 3,016,774. The operator of the machine was able to set a desired torque through the use of a potentiometer and after depressing the trigger or start switch of the machine, torque would be applied to the connector until the motor stalled, which would take place when the desired level of torque had been applied. It was not an uncommon practice in such devices for the operator to set a higher level of torque than that required for the particular size of connector in order to have the machine run at a high speed and for the operator to then sense when he or she felt the desired level of torque had been reached, at which time the trigger or start switch would be released. This resulted in an uneven application of torque and an unreliable application of twist-on connectors to wire ends.

The present invention overcomes the problem of uneven and unreliable torque application as described by completely automating the application of torque to the twist-on connector once the operator has set a desired level of torque. The applicator tool does not stall when the desired level of torque has been reached, but, rather, reverses its direction and releases the connector. Once the operator has set a desired level of torque, which may be done by an input keyboard, and the trigger or start switch is operated, the entire method of applying torque is totally automatic and can only be aborted if the operator releases the trigger. The torque being applied by the electric drive motor in the applicator tool is continuously monitored and at such time as the desired level of torque has been reached, the drive motor is brought to a stop, its direction of rotation reversed and the connector released thereby.

Figure 1:
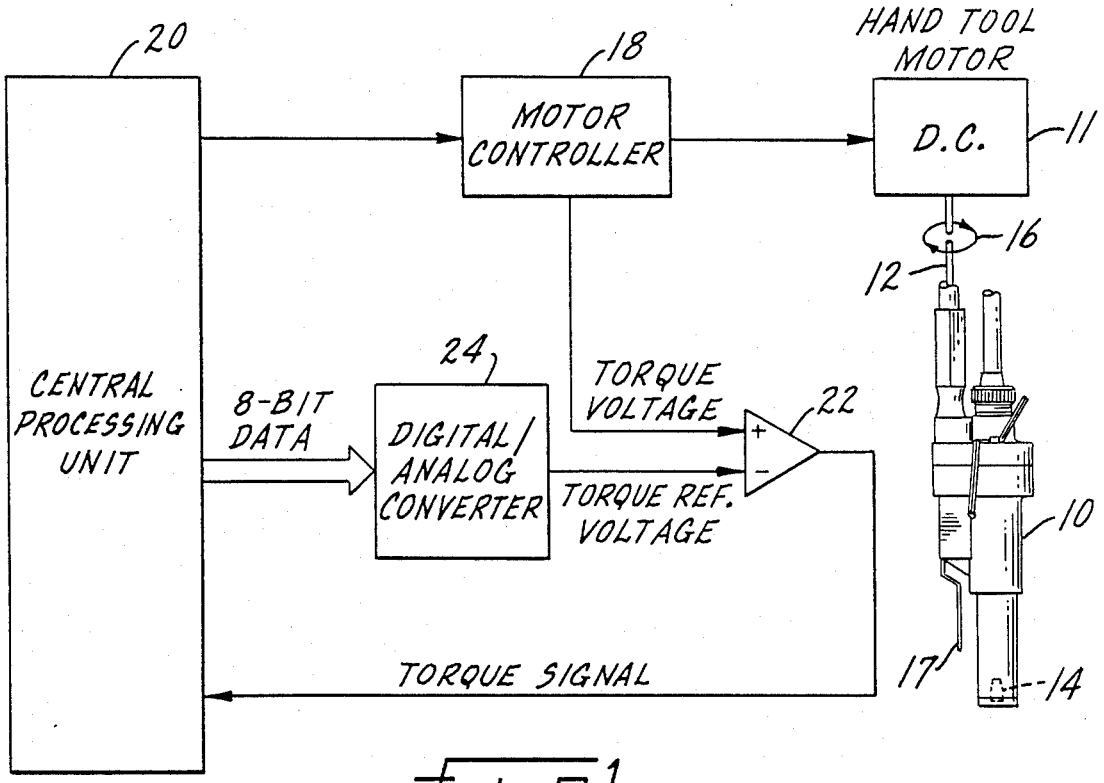
FIG. 1 is an electrical block diagram of the control system described herein.

The present invention is particularly formed and adapted to drive a twist-on wire connector, for example of the type manufactured by Ideal Industries, Inc. and sold under the trademark WIRE NUTS. These connectors have an exterior fluted surface which provides a means for a tool to grip the exterior of the connector and rotate it about the stripped ends of wires which are positioned within it. In FIG. 1 an applicator tool 10 is operated by a direct current motor 11 having an output shaft 12. The tool 10 may be constructed as shown in U.S. Pat. No. 3,016,774 and has a twist-on wire connector 14 positioned therein, with the direction of rotation of motor 11 and its shaft 12 indicated by arrow 16. A trigger 17 is used to operate tool 10.

Motor 11 receives its driving electric power from a motor controller 18 which is controlled by a central processing unit (CPU) 20. Connected to one output from motor controller 18 is a comparison circuit 22 which receives a second input from a digital to analog converter 24, with the output from the comparison circuit being connected back to the CPU 20.

Figure 2:
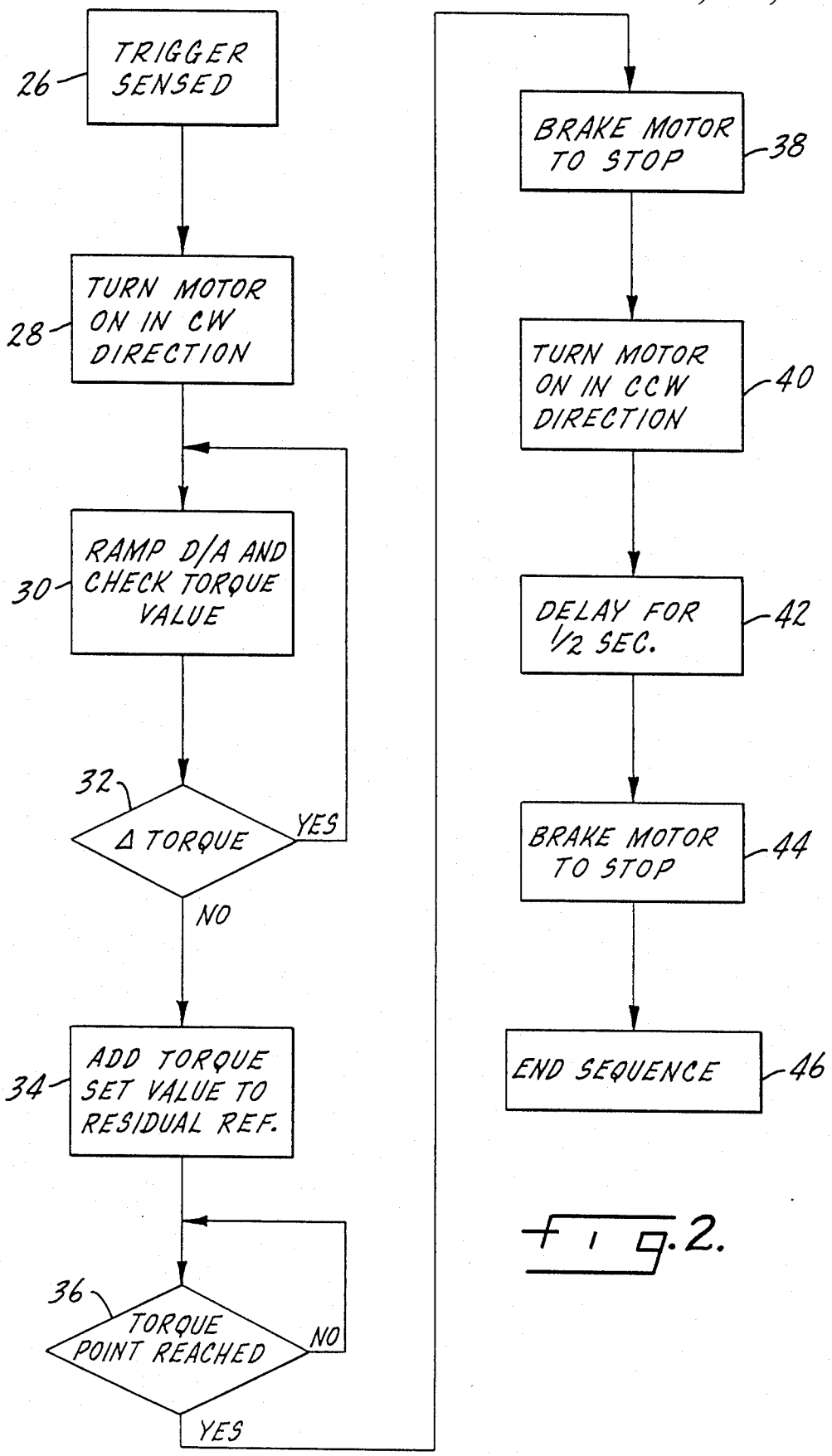
FIG. 2 is a flow diagram illustrating the software program used in the central processing unit of FIG. 1.

FIG. 2 illustrates in flow chart form the software which programs CPU 20 which may be an Intel 8031 from the Intel 8051 series of microprocessors. The operation of the connector applicator tool is initiated when the operator closes trigger 17 and this is indicated by box 26 in the flow chart. Closing of the trigger or start switch will turn motor 11 on and it will be rotated in a clockwise direction and this step in the process is indicated by box 28.

When an electric motor is first turned on, there will be a rapid increase in the motor torque until it reaches a steady state no-load value. In the present instance, comparison circuit 22 monitors the torque of motor 11 by comparing the torque voltage as provided by controller 18 and with a signal from the CPU representative of a torque value. Initially, CPU 20 will provide a digital signal representative of an increasing voltage to the D to A converter 24 and the increasing voltage at the output of converter 24 will be continually compared with the torque voltage of motor 11 until a steady state no-load torque has been reached. This process is indicated by box 30, the yes/no outputs of delta torque box 32 and the closed loop from the yes output of box 32 back to the input of box 30. At such time as there is no longer a change in the output torque of motor 10, the program proceeds to the next step, illustrated by box 34, which is to add to the steady state no-load torque value a voltage representative of the desired level of torque. In the apparatus disclosed, the desired level of torque may be set in a number of ways, however, in the preferred form the operator will have a small keyboard which may be used to provide an input of a desired level of torque to the CPU. The CPU will add the desired level of torque to the no-load torque and provide a digital signal representative of this value to converter 24.

The analog output from D to A converter 24 representative of a desired torque to be applied to a connector is one of the inputs to comparison circuit 22. Comparison circuit 22 will continually monitor the torque voltage of motor 11 and at such time as motor torque equals the output from converter 24, there will be a signal sent back to the CPU. The program is illustrated by box 36 in which the "no" line is representative of the continuing comparison process and at such time as the desired level of torque has been reached, the program will then move to the next step which, as illustrated in box 38, is to provide a signal from CPU 20 to motor controller 18 to brake motor 11 to a stop. When the motor has stopped, it will then be turned on in a counterclockwise direction which is the reverse direction from that used to apply torque to the connector. This is illustrated by box 40 in the program flow chart. After the motor has been turned on in the reverse direction, there is a one-half second delay, indicated by box 42, after which the motor is braked to a stop, as indicated by box 44, which is then the end of the connector application sequence, as indicated by box 46.

When the motor is turning in a counterclockwise or reverse direction, the applicator tool is retracting and releasing the connector. Thus, after the desired level of torque has been applied, the torque applicator motor is braked to a stop and then operated in a reverse direction to retract the tool and release the connector.

Of particular importance in the invention is the fact that the entire sequence of operations from the closing of the trigger or start switch until release of the connector is auto-automatic. The operator may abort the process by releasing the trigger, but control of the application of torque by the tool to the twist-on connector is entirely under the control of the central processing unit and thus the tool itself. The torque applied will be uniform and will be dependent upon the initial operator setting. Normally, the motor will reach a steady state, no-load operating condition in only a few milliseconds, and thus as soon as the trigger is operated, the operator may place the wires to be connected within the connector position within the applicator tool.

Whereas the preferred form of the invention has been shown and described herein, it should be realized that there may be many modifications, substitutions and alterations thereto.

The embodiments of the invention in which an exclusive property or privilege is claimed are defined as follows:

1. A method of controlling torque in an electric motor driven connector tool in which the tool applies a desired torque to a wire connector and a plurality of wire ends positioned therein including the steps of:

(1) setting a desired level of torque to be applied, (2) monitoring electric motor torque from start-up until there is no further change in motor torque indicating the motor has reached a steady state no-load torque.

(3) adding, when the motor has reached a steady state no-load condition, a voltage representative of the no-load torque to a voltage representative of the desired level of tightening torque, (4) monitoring the torque applied by the connector tool electric motor as it turns a wire connector with wire ends positioned therein by comparing electric motor torque voltage with the voltage representative of the sum of the desired level of torque and the no-load torque.

(5) stopping the electric motor when the desired level of torque has been reached, and (6) releasing the connector.

* * * * *